US010876731B2

(12) United States Patent
Dolmansley et al.

(10) Patent No.: US 10,876,731 B2
(45) Date of Patent: Dec. 29, 2020

(54) SWIRLER FOR MIXING FUEL WITH AIR IN A COMBUSTION ENGINE

(71) Applicant: Siemens Aktiengesellschaft, Munich (DE)

(72) Inventors: Timothy Dolmansley, Sheffield (GB); James Hird, Lincoln (GB)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 102 days.

(21) Appl. No.: 16/089,635

(22) PCT Filed: Apr. 21, 2017

(86) PCT No.: PCT/EP2017/059565
§ 371 (c)(1),
(2) Date: Sep. 28, 2018

(87) PCT Pub. No.: WO2017/182658
PCT Pub. Date: Oct. 26, 2017

(65) Prior Publication Data

US 2019/0086090 A1 Mar. 21, 2019

(30) Foreign Application Priority Data

Apr. 22, 2016 (EP) ..... 16166716

(51) Int. Cl.
*F23R 3/14* (2006.01)
*F23R 3/28* (2006.01)
*F23C 7/00* (2006.01)

(52) U.S. Cl.
CPC ..... *F23R 3/14* (2013.01); *F23C 7/004* (2013.01); *F23R 3/286* (2013.01); *F23C 2900/07001* (2013.01)

(58) Field of Classification Search
CPC .. F23R 3/14; F23R 3/286; F23C 7/004; F23C 2900/07001
See application file for complete search history.

(56) References Cited

U.S. PATENT DOCUMENTS 5,558,515 A 9/1996 Althaus et al.
5,927,076 A 7/1999 Pillsbury
(Continued)

FOREIGN PATENT DOCUMENTS

CN 1384908 A 12/2002
CN 102062412 A 5/2011
(Continued)

OTHER PUBLICATIONS

International search report and written opinion dated Jul. 11, 2017, for corresponding PCT/EP2017/059565.

*Primary Examiner* — Gerald L Sung
*Assistant Examiner* — Katheryn A Malatek

(57) ABSTRACT

A swirler for mixing fuel with air in a combustion engine includes a central axis, a swirler base with an upper surface, a central portion, a number of main swirler elements and a number of obstruction elements. The main swirler elements and the obstruction elements are located at the upper surface of the swirler base and are arranged around the central portion. The main swirler elements form a number of swirler slots configured for directing a fluid towards the central portion. Each swirler slot has a slot inlet and a slot outlet, wherein the slot outlet is located at a smaller radial distance from the central axis than the swirler inlet. Each obstruction element is located at a slot inlet and configured for forming a plurality of flow channels into the swirler slot.

18 Claims, 9 Drawing Sheets

(56) References Cited

U.S. PATENT DOCUMENTS

| | | | | |
|---|---|---|---|---|
| 2002/0174656 | A1* | 11/2002 | Hein | F23C 7/004 60/737 |
| 2003/0115884 | A1* | 6/2003 | Boardman | F23R 3/14 60/776 |
| 2009/0025395 | A1* | 1/2009 | Nilsson | F23C 7/004 60/748 |
| 2009/0320485 | A1* | 12/2009 | Wilbraham | F23R 3/14 60/748 |

FOREIGN PATENT DOCUMENTS

| | | | |
|---|---|---|---|
| CN | 103807879 | A | 5/2014 |
| CN | 104764044 | A | 7/2015 |
| EP | 0982545 | A2 | 3/2000 |
| EP | 1096201 | A1 | 5/2001 |
| EP | 2107301 | A1 | 10/2009 |
| JP | H06502240 | A | 3/1994 |
| JP | H07180835 | A | 7/1995 |
| JP | H09119641 | A | 5/1997 |
| JP | 2000065355 | A | 3/2000 |
| JP | 2003513223 | A | 4/2003 |
| JP | 2013517440 | A | 5/2013 |
| RU | 2435101 | C2 | 11/2011 |
| RU | 2467253 | C2 | 11/2012 |

* cited by examiner

SWIRLER FOR MIXING FUEL WITH AIR IN A COMBUSTION ENGINE

CROSS REFERENCE TO RELATED APPLICATIONS

This application is the US National Stage of International Application No. PCT/EP2017/059565 filed Apr. 21, 2017, and claims the benefit thereof. The International Application claims the benefit of European Application No. EP16166716 filed Apr. 22, 2016. All of the applications are incorporated by reference herein in their entirety.

FIELD OF THE INVENTION

The present invention relates to a swirler for mixing fuel with air in a combustion engine and a method for mixing fuel with air. The invention further relates to a burner and a gas turbine.

BACKGROUND OF INVENTION

Fuel placement and mixing is critical for all combustion systems. The correct fuel placement and the correct mixing profile alters factors such as NOx, burner wall temperatures, combustion efficiency and the position and stability of the flame. Radial swirler combustion systems require placement of the fuel into at least two regions; one for the pilot flame and one for the main flame. Each system should have the correct amount of air mixed into it to give the correct pilot/main split and also be mixed well enough to give a homogeneous mixture fraction in each flame.

Radial swirlers use injection holes for the gas flow in the side of the swirler slots and in the base of the swirler to mix the fuel with the air. There is also a secondary fuel injection towards the inner recirculation zone to direct pilot fuel to this region. Full mixing is not always achieved, especially over the full load range.

SUMMARY OF THE INVENTION

It is an objective of the present invention to provide an advantageous swirler with improved mixing properties.

The objective is solved by a swirler for mixing fuel with air, a burner, a gas turbine and a method for mixing fuel with air as claimed. The depending claims define further developments of the present invention.

The inventive swirler for mixing fuel with air in a combustion engine comprises a central axis, a swirler base comprising an upper surface, a central portion, a number of main swirler components or swirler elements and a number of obstruction components or obstruction elements. The main swirler elements and the obstruction elements are located at the upper surface of the swirler base. The main swirler elements and the obstruction elements are arranged around the central portion. The main swirler elements are forming a number of swirler slots. The swirler slots are configured for directing a fluid towards the central portion, for example towards the central axis. Each swirler slot comprises a slot inlet and a slot outlet. The slot outlet is located at a smaller radial distance from the central axis than the swirler inlet. Each obstruction element is located at a slot inlet and configured for forming or providing a plurality of flow channels, advantageously two flow channels, into the swirler slot.

The idea of the invention is to split the air flow into the swirler slot into advantageously two flows. Where these flows meet there will be a region of high turbulence. Fuel injected into this region will be well mixed and will also have the full length of the swirler slot to continue mixing before meeting with a second region of high turbulence where the slots join together.

The swirler base can be a base portion or base component or element. The swirler base and/or the main swirler elements and/or the obstruction elements can be separate components or can be formed as one piece.

The inlet edges of the slot inlets are advantageously rounded to reduce the pressure drop. In a variant the main swirler elements and/or the obstruction elements can comprise a leading edge comprising a rounded shape.

The swirler slots may be configured for directing a fluid towards the central axis, especially at least one slot comprises an outlet with a centre line, which may be identical with a main flow direction through the slot outlet. The centre line runs perpendicular to the central axis of the swirler and includes an angle with a radial direction towards the centre of the slot outlet between 10° and 70°, advantageously between 40° and 60°.

In advantageous variants least one obstruction element has a round or oval or teardrop shaped or square shaped or diamond shaped cross section in a plane perpendicular to the central axis, which means in a radial plane. The obstructions in the swirler slot should induce turbulence in the flow to improve the mixing of the fuel. The different shapes may be selected with the aim to improve the aerodynamic characteristics, especially the characteristics of the induced turbulence, and/or with the aim to reduce manufacturing costs.

The obstruction elements can be made up of several parts with holes or partitions between the sections to further induce turbulent mixing. Fuel is advantageously injected into the turbulent region immediately after the obstruction element to obtain the major benefit.

At least one, advantageously each, slot comprises a height $h_s$ in axial direction measured from the upper surface of the swirler base and at least one, advantageously each, obstruction element comprises a height $h_o$ in axial direction measured from the upper surface of the swirler base. For example the height $h_o$ of the obstruction element is equal or smaller than the height $h_s$ of the slot ($h_o \leq h_s$). In other words, the obstruction elements do not have to be the full height of the swirler slot. The major benefit is thought to be with a height of 100% of the slot but additional benefits could be obtained with an obstruction element which is only part of the swirler slot height. Any obstruction can be the full height of the slot or only part of the height to induce turbulence in several different planes.

In a further variant at least one obstruction element splits part of a slot, especially the inlet portion of the slot, into a first flow channel portion with a first cross sectional area and a second flow channel portion with a second cross sectional area. The first and the second cross sectional area are equal or differ from each other in maximum 10%. In other words the cross sectional area of one of the flow channels is maximum 10% smaller or maximum 10% larger than the cross sectional area of the other flow channel. This means that the ratio of passages does not have to be equal but can be determined to give the highest turbulence ratio. However, the optimum is thought to be when the passages are equal width or within 10% difference from each other.

At least one slot comprises a slot length from the slot inlet to the slot outlet. Advantageously at least one obstruction element, advantageously each obstruction element, penetrates into the slot by a length of less than 70% of the slot length, for example between 10% and 30%, advantageously 20%. A centrally positioned obstruction element at the slot inlet should not penetrate more than 70% of the slot length, but the major benefit would be thought to occur if the penetration was 20% of the swirler slot length from the outside inwards. The balance is between having enough length that the airflow has resolved in that direction and making the joint between the flows sharp. Moreover, the longer the length after the fuel injection the more mixing that can occur within the swirler slot. The length of the obstruction element should also be long enough to prevent the fuel/air mixture flowing back along any of the passages and burning outside a combustion chamber.

The swirler advantageously comprises a number of fuel injectors or means for fuel injection. The fuel injectors can comprise injection holes. In an advantageous variant the swirler comprises a number of fuel injectors or means for fuel injection. The at least one fuel injector can be a gaseous fuel injector and/or a liquid fuel injector.

Generally the swirler base and/or at least one main swirl element and/or at least one obstruction element can comprise at least one fuel injector. The swirler may comprise at least one main fuel injector and/or at least one pilot fuel injector and/or at least one secondary main fuel injector. The at least one main fuel injector and/or at least one pilot fuel injector and/or at least one secondary main fuel injector is advantageously located at or in the upper surface of the swirler base or at a trailing edge of one of the main swirler elements or at a position downstream of one of the obstruction elements with respect to a flow direction in the slot from the slot inlet to the slot outlet or at a position upstream of one of the obstruction elements with respect to a flow direction in the slot from the slot inlet to the slot outlet.

Advantageously, the fuel injector is positioned such that fuel mixing takes place downstream of the obstruction element, especially such that either the fuel can be injected downstream into a turbulent region directly or it can be injected upstream so that the air flow carries the fuel into the turbulent region.

Furthermore, the obstruction element can comprise at least one side surface and/or the main swirler element can comprise at least one side surface. At least one fuel injector can be located at the side surface of the obstruction element or at the side surface of the main swirler element.

A number of fuel injectors are for example located at one of the main swirler elements and/or at one of the obstruction elements at different heights measured from the swirler base in axial direction. They can be located at a side surface or at a trailing edge of the particular element. The number of fuel injectors are for instance located at a height of between 60% and 90% of the height of the slot or between 60% and 90% of the height of the main swirl element or between 60% and 90% of the height of the obstruction element.

Generally, the fuel injectors can be holes or slots or can have any injection shape.

For example, gas fuel can be injected from the trailing edge of an obstruction element (see position 1 in FIG. 2). The number of injectors can be 1 or more but 3 is the optimum, probably situated towards the top ⅔rds of the slot. Liquid can also be injected from this trailing edge if the internal feed pipes can be situated to avoid the gas feed pipes (see position 6 in FIG. 2).

Another location for the injectors or feeds could be on the side of a central obstruction element with staggered injectors or feeds, e.g. 4 feeds, 2 on either side but with different heights from the base of the slot, e.g. 70% and 90% of the height on one side and 60% and 80% on the other side (see position 2 in FIG. 2).

Fuel can also be fed from the outside of the passages into the slot (see position 3 in FIG. 2). Main liquid should also be positioned at the wedge tip of the obstruction (position 5 or 6 in FIG. 2). Pilot fuel can be injected at the base of the swirler, towards the inner radius, with a low penetration or from inside the swirler radius altogether.

The pilot or a secondary main fuel injector or feed can be positioned at different heights on the trailing edges of the main swirler element or component to further enhance the mixing properties (see position 4 in FIG. 2). Pilot fuel may be injected towards the base of this edge and main fuel may be injected towards the top. A liquid injector can also be placed in one of these locations (see position 7 in FIG. 2). A good liquid pilot location can be facing 90° to the base, from the base of the slot in line with the end of the swirler point (see position 5 in FIG. 2). An injection angled centrally or from the end of the swirler nose radially inwards is also beneficial.

The inventive burner for a combustion engine comprises at least one swirler as previously described. The inventive gas turbine comprises at least one swirler as previously described and/or at least one burner as previously described. The burner and the gas turbine have the same properties and advantages as the described swirler.

The inventive method for mixing fuel with air for use in a combustion engine, for example a burner or a gas turbine, comprises the following steps: injecting air into slot inlets of a previously described swirler and injecting fuel into the air flow, especially into a turbulent air flow, through at least one fuel injector of the swirler. The method has the same properties and advantages as the described swirler.

The fuel can, for example, be injected downstream or upstream of at least one obstruction element with respect to a flow direction in the slot from the slot inlet to the slot outlet.

Advantageously, the fuel is injected such that fuel mixing takes place downstream of the obstruction element. Either the fuel can be injected downstream into a turbulent region directly or it can be injected upstream so that the air flow carries the fuel into the turbulent region. In other words, fuel is injected to mix fuel and air downstream of the obstruction element by injecting fuel into a turbulent region or upstream of the turbulence created by the obstruction so that the airflow carries the fuel into this region.

Generally the invention has the advantage that the additional obstruction elements in the swirler slot induce turbulence and aid mixing, especially mixing with different shapes to increase turbulent mixing at the fuel injection point. Furthermore, novel fuel injection locations are provided, which improve the mixing result.

BRIEF DESCRIPTION OF THE DRAWINGS

The above mentioned attributes and other features and advantages of this invention and the manner of attaining them will become more apparent and the invention itself will be better understood by reference to the following description of embodiments of the invention taken in conjunction with the accompanying drawings. The embodiments do not limit the scope of the present invention which is determined by the appended claims. All described features are advantageous as separate features or in any combination with each other.

DETAILED DESCRIPTION OF THE INVENTION

Figure 1:
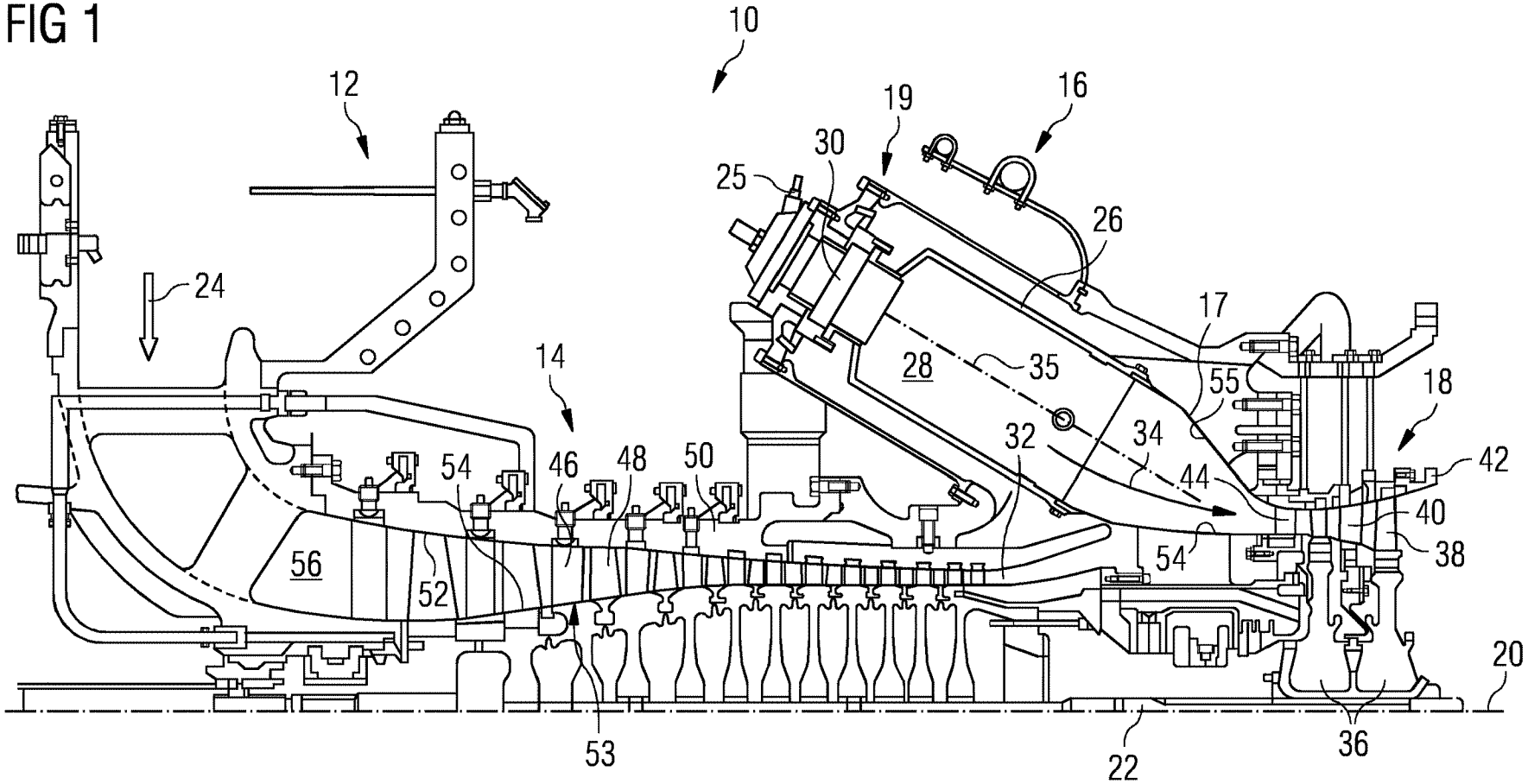
FIG. 1 schematically shows part of a turbine engine in a sectional view.

FIG. 1 shows an example of a gas turbine engine 10 in a sectional view. The gas turbine engine 10 comprises, in flow series, an inlet 12, a compressor section 14, a combustor section 16 and a turbine section 18 which are generally arranged in flow series and generally about and in the direction of a longitudinal or rotational axis 20. The gas turbine engine 10 further comprises a shaft 22 which is rotatable about the rotational axis 20 and which extends longitudinally through the gas turbine engine 10. The shaft 22 drivingly connects the turbine section 18 to the compressor section 14.

In operation of the gas turbine engine 10, air 24, which is taken in through the air inlet 12 is compressed by the compressor section 14 and delivered to the combustion section or burner section 16. The burner section 16 comprises a burner plenum 26, one or more combustion chambers 28 and at least one burner 30 fixed to each combustion chamber 28. The combustion chambers 28 and the burners 30 are located inside the burner plenum 26. The compressed air passing through the compressor 14 enters a diffuser 32 and is discharged from the diffuser 32 into the burner plenum 26 from where a portion of the air enters the burner 30 and is mixed with a gaseous or liquid fuel. The air/fuel mixture is then burned and the combustion gas 34 or working gas from the combustion is channelled through the combustion chamber 28 to the turbine section 18 via a transition duct 17.

This exemplary gas turbine engine 10 has a cannular combustor section arrangement 16, which is constituted by an annular array of combustor cans 19 each having the burner 30 and the combustion chamber 28, the transition duct 17 has a generally circular inlet that interfaces with the combustor chamber 28 and an outlet in the form of an annular segment. An annular array of transition duct outlets form an annulus for channelling the combustion gases to the turbine 18.

The turbine section 18 comprises a number of blade carrying discs 36 attached to the shaft 22. In the present example, two discs 36 each carry an annular array of turbine blades 38. However, the number of blade carrying discs could be different, i.e. only one disc or more than two discs. In addition, guiding vanes 40, which are fixed to a stator 42 of the gas turbine engine 10, are disposed between the stages of annular arrays of turbine blades 38. Between the exit of the combustion chamber 28 and the leading turbine blades 38 inlet guiding vanes 44 are provided and turn the flow of working gas onto the turbine blades 38.

The combustion gas from the combustion chamber 28 enters the turbine section 18 and drives the turbine blades 38 which in turn rotate the shaft 22. The guiding vanes 40, 44 serve to optimise the angle of the combustion or working gas on the turbine blades 38.

The turbine section 18 drives the compressor section 14. The compressor section 14 comprises an axial series of vane stages 46 and rotor blade stages 48. The rotor blade stages 48 comprise a rotor disc supporting an annular array of blades. The compressor section 14 also comprises a casing 50 that surrounds the rotor stages and supports the vane stages 48. The guide vane stages include an annular array of radially extending vanes that are mounted to the casing 50. The vanes are provided to present gas flow at an optimal angle for the blades at a given engine operational point. Some of the guide vane stages have variable vanes, where the angle of the vanes, about their own longitudinal axis, can be adjusted for angle according to air flow characteristics that can occur at different engine operations conditions.

The casing 50 defines a radially outer surface 52 of the passage 56 of the compressor 14. A radially inner surface 54 of the passage 56 is at least partly defined by a rotor drum 53 of the rotor which is partly defined by the annular array of blades 48.

The present invention is described with reference to the above exemplary turbine engine having a single shaft or spool connecting a single, multi-stage compressor and a single, one or more stage turbine. However, it should be appreciated that the present invention is equally applicable to two or three shaft engines and which can be used for industrial, aero or marine applications.

The terms upstream and downstream refer to the flow direction of the airflow and/or working gas flow through the engine unless otherwise stated. The terms forward and rearward refer to the general flow of gas through the engine. The terms axial, radial and circumferential are made with reference to the rotational axis 20 of the engine.

Figure 2:
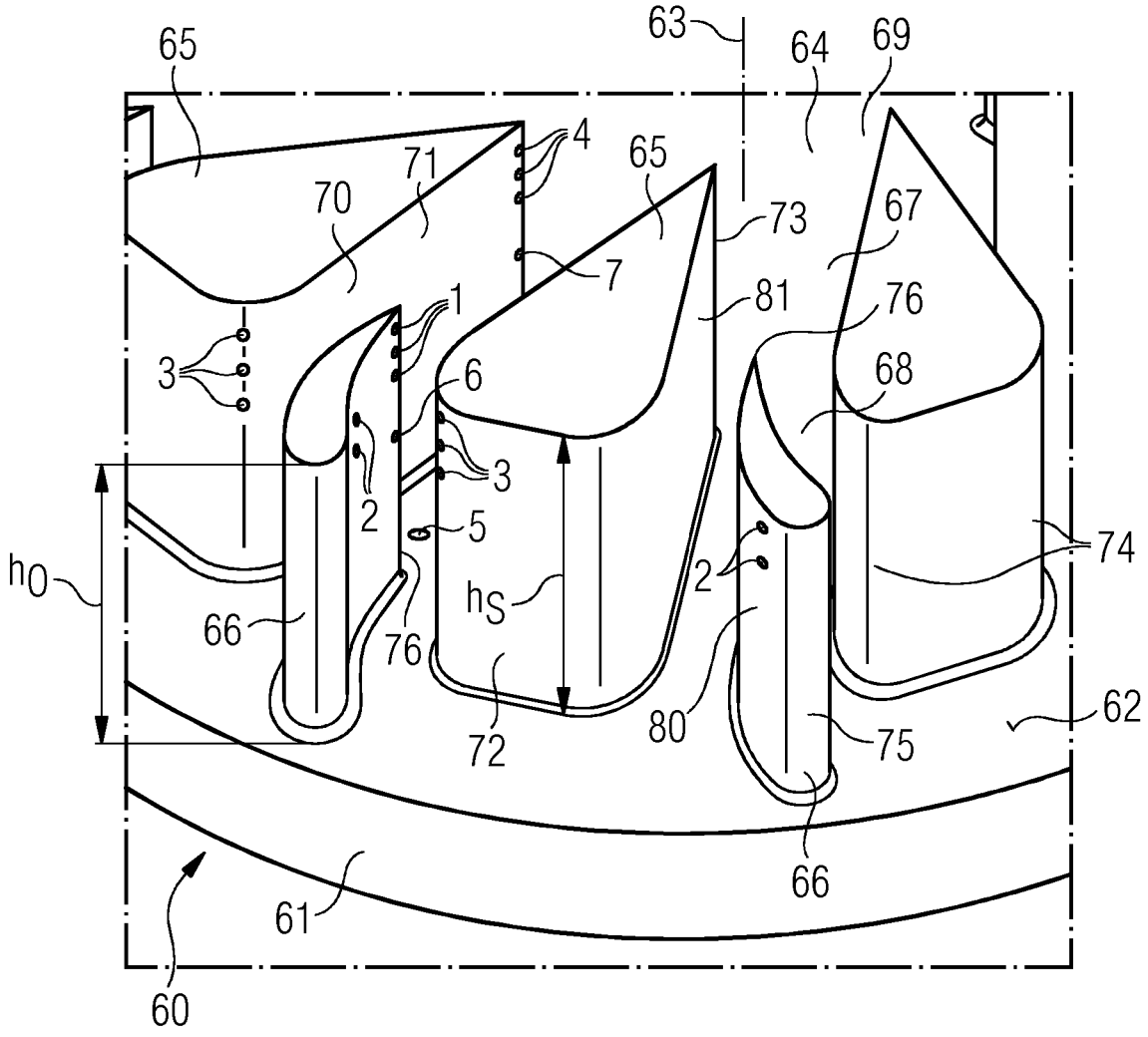
FIG. 2 schematically shows an example of an inventive swirler in a perspective view.
Figure 3:
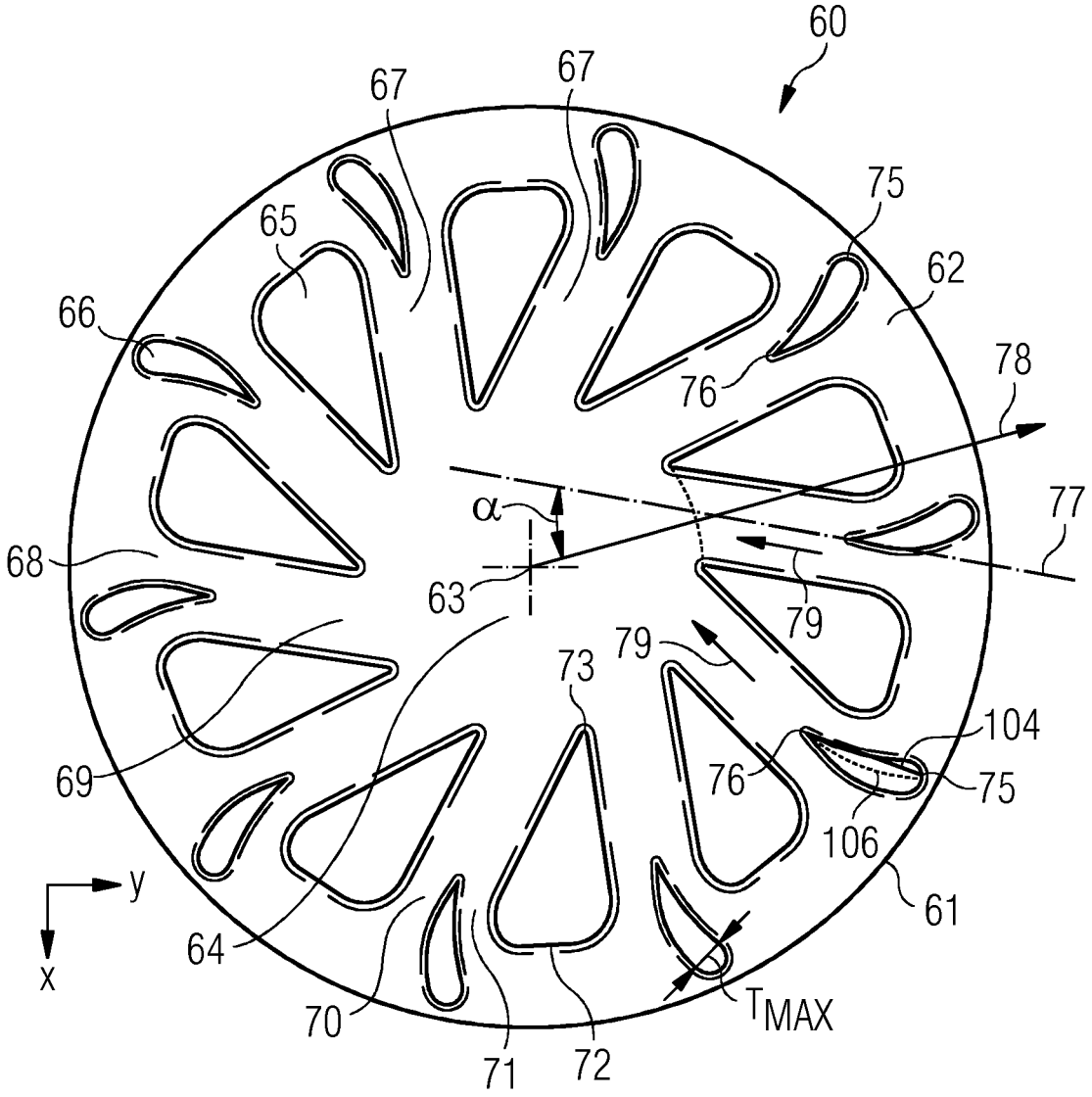
FIG. 3 schematically shows the swirler of FIG. 2 in a top view.
Figure 4:
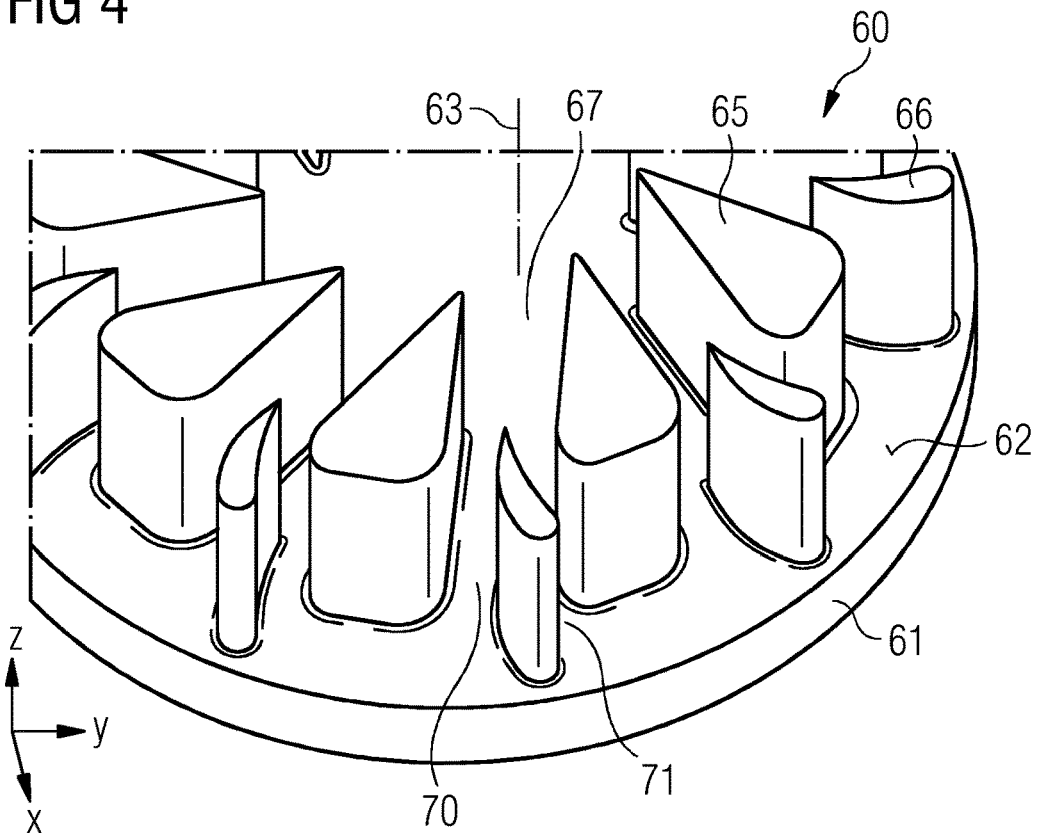
FIG. 4 schematically shows the swirler of FIG. 2 in another perspective view.
Figure 5:
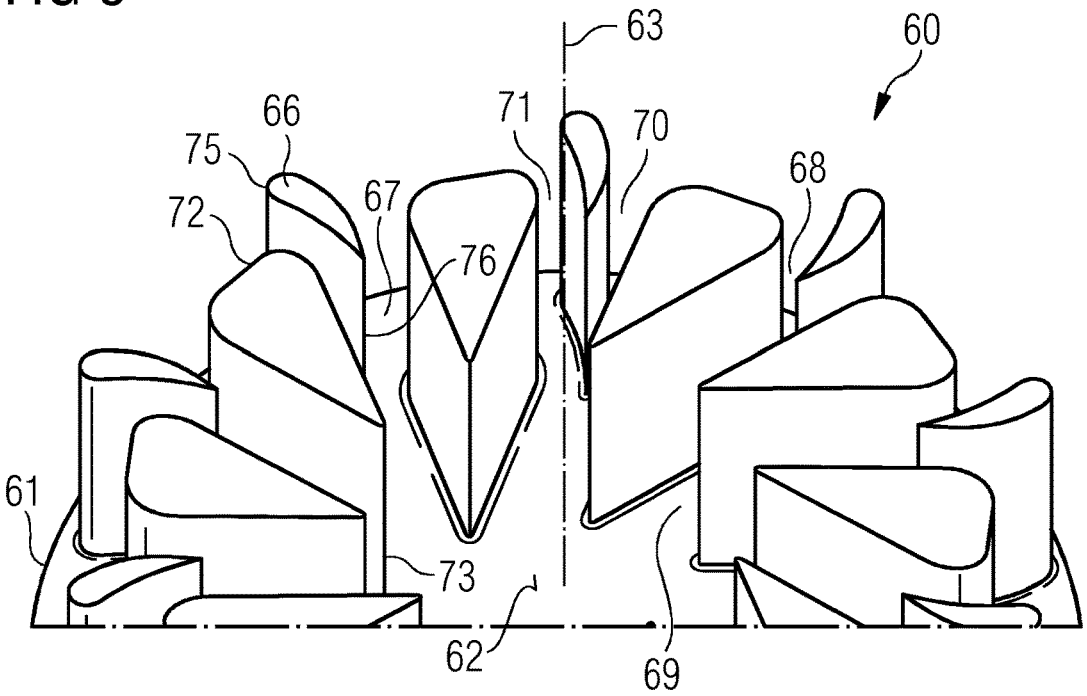
FIG. 5 schematically shows the swirler of FIG. 2 in a further perspective view.

FIG. 2 schematically shows an example of an inventive swirler 60 in a perspective view. FIG. 3 schematically shows the swirler of FIG. 2 in a top view. FIG. 4 schematically shows the swirler of FIG. 2 in another perspective view. FIG. 5 schematically shows the swirler of FIG. 2 in a further perspective view.

The swirler 60 for mixing fuel with air comprises a central axis 63, a swirler base 61 comprising an upper surface 62, a central portion 64, a number of main swirler components or swirler elements 65 and a number of obstruction components or obstruction elements 66. The main swirler elements 65 and the obstruction elements 66 are located at the upper surface 62 of the swirler base 61. The main swirler elements 65 and the obstruction elements 66 are arranged around the central portion 64. The main swirler elements 65 are forming a number of swirler slots 67. The swirler slots 67 are configured for directing a fluid towards the central portion 64, for example towards the central axis 63. Each swirler slot 67 comprises a slot inlet 68 and a slot outlet 69. The slot outlet 69 is located at a smaller radial distance from the central axis 63 than the swirler inlet 68. Each obstruction element 66 is located at a slot inlet 68 and configured for forming or providing a plurality of flow channels, advantageously two flow channels 70 and 71, into the swirler slot 67.

Each main swirler element 65 comprises a leading edge 72 and a trailing edge 73. The inlet edges 74 of the main swirler element 65 at the swirler slot 67 are advantageously rounded to reduce the pressure drop.

The obstruction elements 66 in FIG. 2 have a teardrop shape in a radial plane. Each obstruction element 66 comprises a leading edge 75 and a trailing edge 76.

The swirler slots 67 may be configured for directing a fluid towards the central axis 63. Especially at least one slot 67 comprises an outlet 69 with a centre line 77, which may be identical with a main flow direction 79 through the slot outlet 69. The centre line 77 runs perpendicular to the central axis 63 of the swirler 60 and includes an angle $\alpha$ with a radial direction 78 towards the centre of the slot outlet 69 between 10° and 70°, for example between 40° and 60°.

The obstruction element 66 splits part of a slot 67, especially the inlet portion 68 of the slot 67, into a first flow channel portion 70 with a first cross sectional area and a second flow channel portion 71 with a second cross sectional area. The first and the second cross sectional area can be equal or differ from each other in maximum 10%.

At least one slot comprises a slot length from the slot inlet 68 to the slot outlet 69. Advantageously each obstruction element 66 penetrates into the slot 67 by a length of less than 70% of the slot length, for example between 10% and 30%, advantageously 20%.

The swirler advantageously comprises a number of fuel injectors or means for fuel injection. The fuel injectors can comprise injection holes or slots or may have any other injection shape. In an advantageous variant the swirler comprises a number of fuel injectors or means for fuel injection. The at least one fuel injector can be a gaseous fuel injector and/or a liquid fuel injector.

FIG. 2 shows examples for different positions of fuel injectors. The shown fuel injectors at the positions 1 to 7 can be present separate or in each combination or all, as shown in FIG. 2.

Generally the swirler base and/or at least one main swirl element 65 and/or at least one obstruction element 66 can comprise at least one fuel injector 1-7. The swirler 60 may comprise at least one main fuel injector and/or at least one pilot fuel injector and/or at least one secondary main fuel injector. The at least one main fuel injector and/or at least one pilot fuel injector and/or at least one secondary main fuel injector is advantageously located at or in the upper surface 62 of the swirler base 61 or at a trailing edge 73 of one of the main swirler elements 65 or at a position downstream of one of the obstruction elements 66 with respect to a flow direction 79 in the slot 67 or at a position upstream of one of the obstruction elements 66 with respect to a flow direction 79 in the slot 67.

Furthermore, the obstruction element 66 can comprise at least one side surface 80 and/or the main swirler element 65 can comprise at least one side surface 81. At least one fuel injector can be located at the side surface 80 of the obstruction element 66 (see location 2) or at the side surface 81 of the main swirler element 65.

The injectors or feeds at position 2 on the side 80 of the obstruction elements 66 may for instance have staggered injector positions or feeds, e.g. 4 feeds, 2 on either side but with different heights from the upper surface 62 of the swirler base 61, e.g. 70% and 90% of the height on one side 80 and 60% and 80% on the other side 80.

Fuel can also be fed from the outside of the passages into the slot 67, for instance at position 3.

Preferably gas fuel can be injected from the trailing edge 76 of the obstruction elements 66 by means of one or more injectors at position 1. The number of injection holes can be 1 or more but 3 would be thought to be the optimum, probably situated towards the top ⅔rds of the slot, in other words at a height of ⅔ of the slot height $h_s$. Liquid fuel can also be injected from this trailing edge 76, for example by means of an injector at position 6, especially if the internal feed pipes can be situated to avoid the gas feed pipes.

Main liquid fuel can also be positioned at the wedge tip of the obstruction elements 66 at position 5 or 6. Pilot fuel can be injected at the base 61 of the swirler 60, towards the inner radius, with a low penetration or from inside the swirler radius altogether.

The pilot or a secondary main feed can be positioned at different heights in axial direction measured from the upper surface 62 on the trailing edges 73 of the main swirler elements 65, for example at position 4. This further enhances the mixing properties. A pilot fuel injector is advantageously position at a lower height (towards the base) of this edge and a main fuel injector is advantageously position at a larger height (towards the top). A liquid injector can also be placed in one of these locations, for instance at position 7. A good liquid pilot location would be facing 90 degress to the base, from the base of the slot in line with the end of the swirler point (position 8 in drawing below). An injection angled centrally or from the end of the swirler nose radially inwards would also be beneficial.

The centrally positioned obstruction element 66 at the swirler inlet 68 should not penetrate more than 70% of the slot 67 length, but the major benefit would be thought to occur if the penetration was 20% of the swirler slot 67 length from the outside inwards. The balance is between having enough length that the airflow has resolved in that direction and making the joint between the flows sharp. Also the longer the length after the fuel injection the more mixing that can occur within the swirler slot. The length of the centrally positioned obstruction element 66, which is located within the slot 67, should also be long enough to prevent the fuel/air mixture flowing back along any of the passages and burning outside the combustion chamber.

Figure 6:
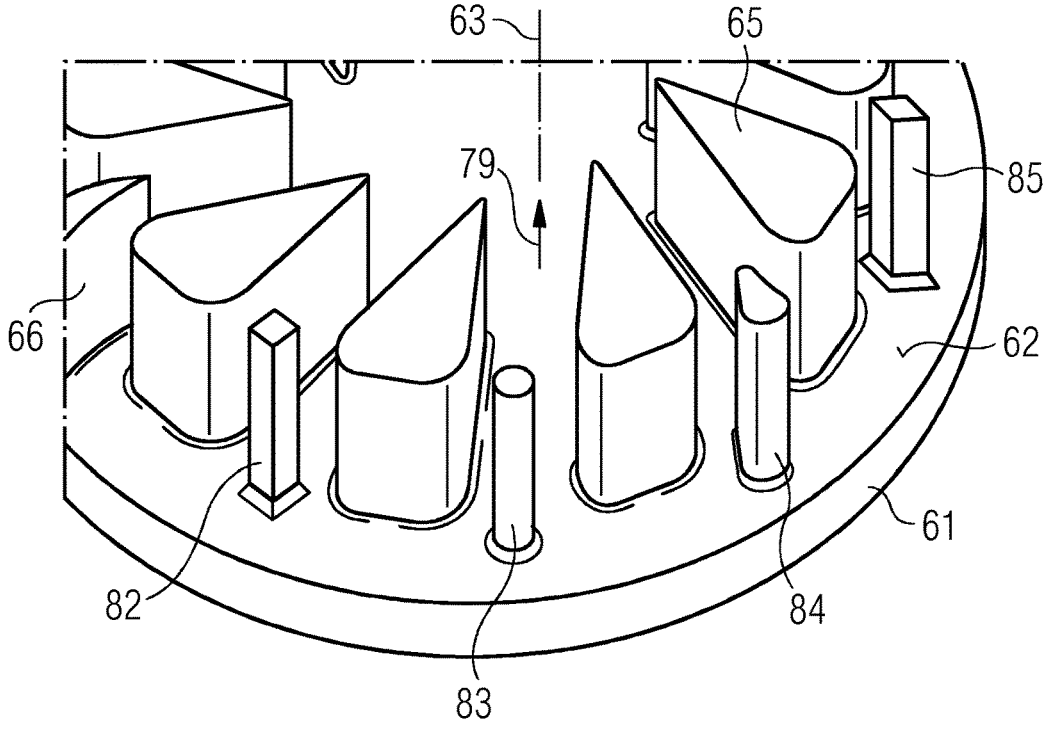
FIG. 6 schematically shows variants of an inventive swirler with examples for differently shaped obstruction elements in a perspective view.

FIG. 6 schematically shows variants of an inventive swirler with examples for differently shaped obstruction elements in a perspective view. Generally, the obstruction elements can have different shapes, especially in a cross section in a radial plane. FIG. 6 shows examples for differently shaped obstruction element in one swirler 60. A swirler 60 can generally comprise obstruction elements of only one of these shapes or any combination of differently shaped obstruction elements. In FIG. 6 the obstruction element 82 has a square shape, the obstruction element 85 has a diamond shape, the obstruction element 83 has a round shape, the obstruction element 84 has an oval shape and the obstruction element 66 has a teardrop shape.

The obstruction can be made up of several parts with holes or partitions between the sections to further induce turbulent mixing. Fuel should be injected into the turbulent region immediately after the obstruction to obtain the major benefit.

At least one, advantageously each, slot comprises a height $h_s$ in axial direction measured from the upper surface of the swirler base and at least one, advantageously each, obstruction element comprises a height $h_o$ in axial direction measured from the upper surface of the swirler base. For example the height $h_o$ of the obstruction element is equal or smaller than the height $h_s$ of the slot ($h_o \leq h_s$). In other words, the obstruction elements do not have to be the full height of the swirler slot. The major benefit is thought to be with a height of 100% of the slot but additional benefits could be obtained with an obstruction element which is only part of the swirler slot height. Any obstruction can be the full height of the slot or only part of the height to induce turbulence in several different planes.

Figure 7:
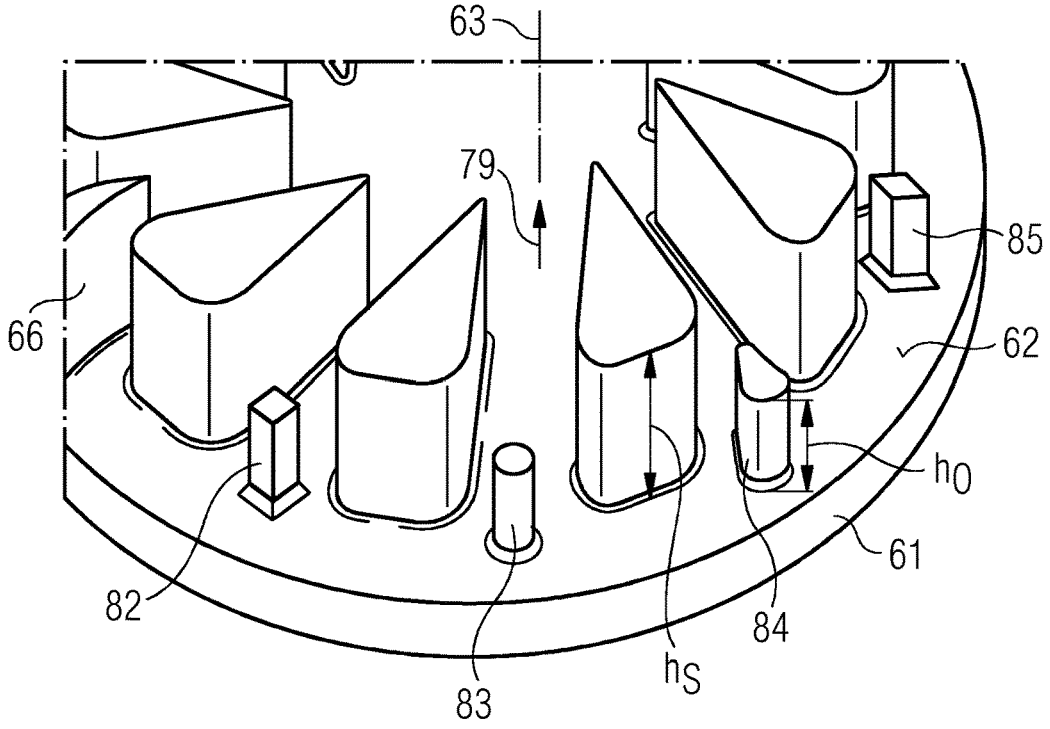
FIG. 7 schematically shows a variant of the swirler of FIG. 6 in a perspective view with obstruction elements having a lower height than the slot height.

FIG. 7 schematically shows a variant of the swirler 60 of FIG. 6 in a perspective view with obstruction elements 66, 82, 83, 84, 85 having a lower height $h_o$ than the slot height $h_s$. Any obstruction can be the full height $h_s$ of the slot or only part of the height to induce turbulence in several different planes.

Reference is now made to an advantageous embodiment of the present swirler and with respect to FIGS. 8 to 11.

Figure 8:
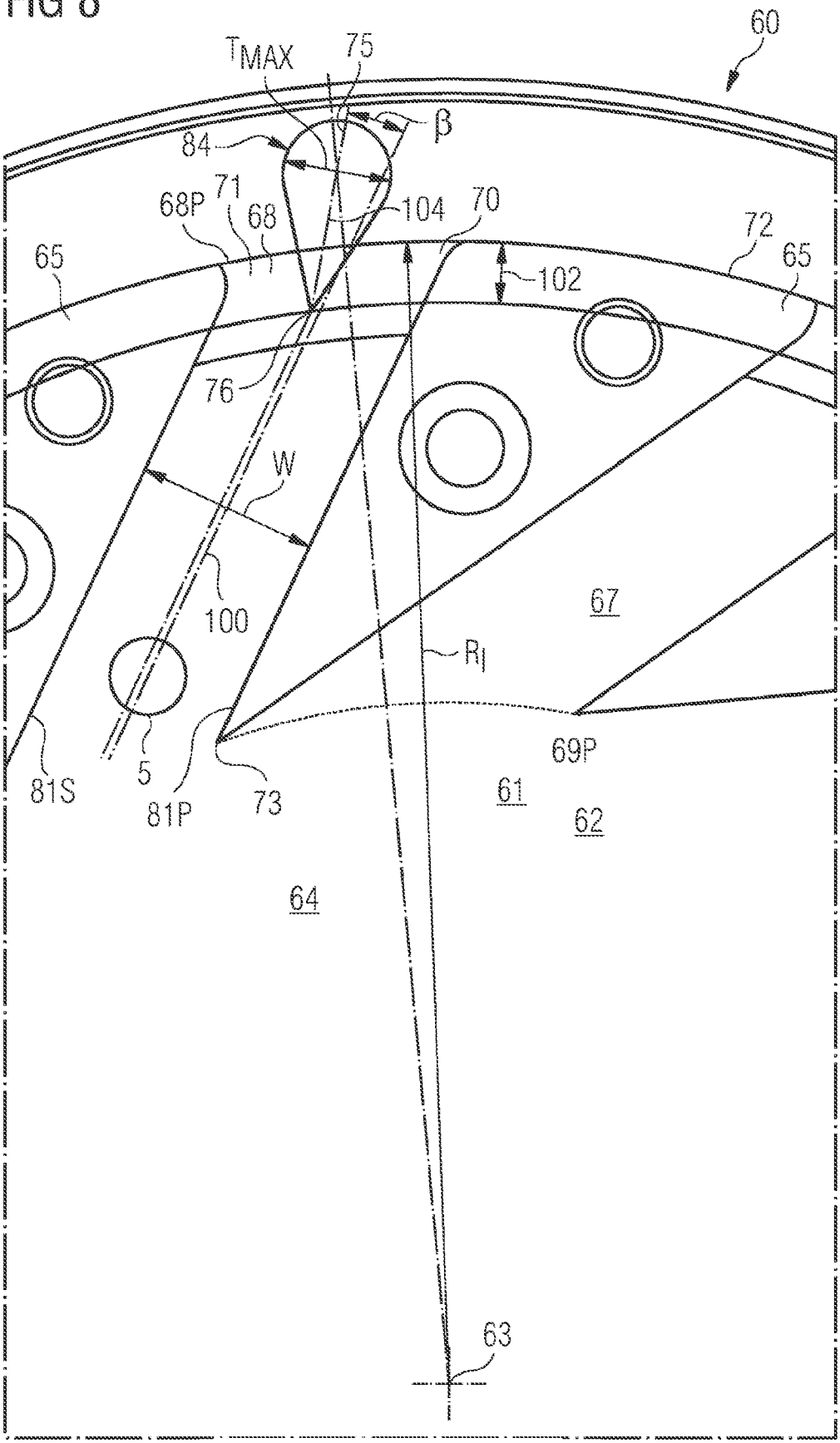
FIG. 8 schematically shows a sector of the swirler of in an axial view detailing the location of the obstruction element(s) relative to the swirler slot.

FIG. 8 shows a sector of a swirler 60 in an axial view and one specific embodiment of the present swirler. A top plate (108 in FIGS. 9, 10 and 11) has been removed for clarity. As discussed before, the swirler 60 comprises a central axis 63, a swirler base (plate) 61 comprising an upper surface 62. An annular array of main swirler elements 65 extends in an axial direction from the base plate 61 to the top plate 108. The main swirler elements 65, base plate 61 and top plate 108 define the swirler slots 67. A number of obstruction elements 66, 84 are located circumferentially between the main swirler elements 65.

Each obstruction element 66, 84 has a leading edge 75 and a trailing edge 76, the trailing edge 76 is located radially inwardly of the leading edge 75. The main swirler elements 65 and the obstruction elements 66 are located at the upper surface 62 of the swirler base 61 and are arranged around the central portion 64.

The swirler slots 67 have a centre-line 100 and are configured for directing a fluid 79 towards the central portion 64. The fluid is compressed air from the compressor section of the gas turbine. Each swirler slot 67 comprises a slot inlet 68, or more precisely a slot inlet plane, formed at a radius Ri (from axis 63) and a slot outlet 69 or more precisely a slot outlet plane. The slot outlet 69 is located at a smaller radial distance, or radially inwardly, from the central axis 63 than the swirler inlet 68.

Importantly, each obstruction element 66 is located to intersect one of slot inlet 68, that is to say the slot inlet plane 68P passes through or cuts the obstruction element 66. The obstruction element 66 and immediately adjacent or facing main swirler element form a plurality of flow channels and in particular two flow channels 70, 71 and which then feed the fluid into the swirler slot 67.

Significantly, the trailing edge 76 of the obstruction element 66, 84 is located or inserted into the swirler slot 64, from radially outwardly, a distance up to 0.2Ri. At least one fuel injector 1, i.e. an outlet 116, 116A, 116B of the fuel injector 1, is formed in the obstruction element 66, 84 and a distance up to 0.2Ri from the trailing edge 76. In other words the fuel outlet(s) 116, 116A, 116B are located radially inwardly of the inlet plane 68P. The fuel outlets 116, 116A, 116B may be located on any part of the surface of the obstruction element that is radially inward of the inlet plane 68P.

The specified arrangement of the obstruction element 66, 84 and the fuel outlet(s) 116, 116A, 116B ensures that there is no premixing of fuel and air prior to or radially outwardly of the swirler slot and avoids flashback of combustion gases. Furthermore, the insertion of the obstruction element into the swirler slot causes a reduced flow area of the swirler slot such that the fluid or air has a higher velocity in channels 71, 70 than radially inwardly of the trailing edge 76. This further reduces or eliminates flashback of combustion gases.

The swirler slot 67 is defined between a pressure surface 81P and a suction surface 81S of opposing main swirlers 65 and has a width W. The trailing edge 76 of the obstruction element(s) 66, 84 is off-set from the centre-line 100 a distance 0.05 W. Preferably the off-set is towards the suction surface 81S. This is advantageous because of the pressure distribution or gradient of the fluid entering the swirler slot is not equal. The off-set of the trailing edge 76 helps to distribute the pressure more favourably so that flashback cannot occur via either of the channels 71 or 70.

The obstruction element 66, 84 has a cross-section in the shape of an aerofoil and has a chord line 104 that extends from the leading edge 75 to the trailing edge 76. The chord line 104 is angled β between 5° and 25°, advantageously between 10° and 20° and advantageously approximately 15° from the centre-line 100. In this configuration, particularly where the angle β is toward to the suction surface 81S of the main swirler element 65, the obstruction element assists in turning the fluid flow 79 into the swirler slot 67 and thereby reducing aerodynamic losses.

The swirler 60 further comprises the top plate 108 which is generally in the form of ring and which is located abutting the axially opposite ends of the main swirler elements 65 to the swirler base 61. At least a portion 110 of the axially opposite end surface 114, to the base plate end, of the obstruction elements 66, 84. Thus the top plate 108 further defines the swirler slots 67. The portion 110 of the axially opposite end surface 114 of the obstruction elements 66, 84 can have the same radial extent (0.2Ri) as the extent of insertion of the obstruction element into the swirler slot. Thus the radially outer periphery of the top plate has the same radius as the leading edge 72 of the main swirler elements, although this does not necessarily need to be so in all examples.

Figure 9:
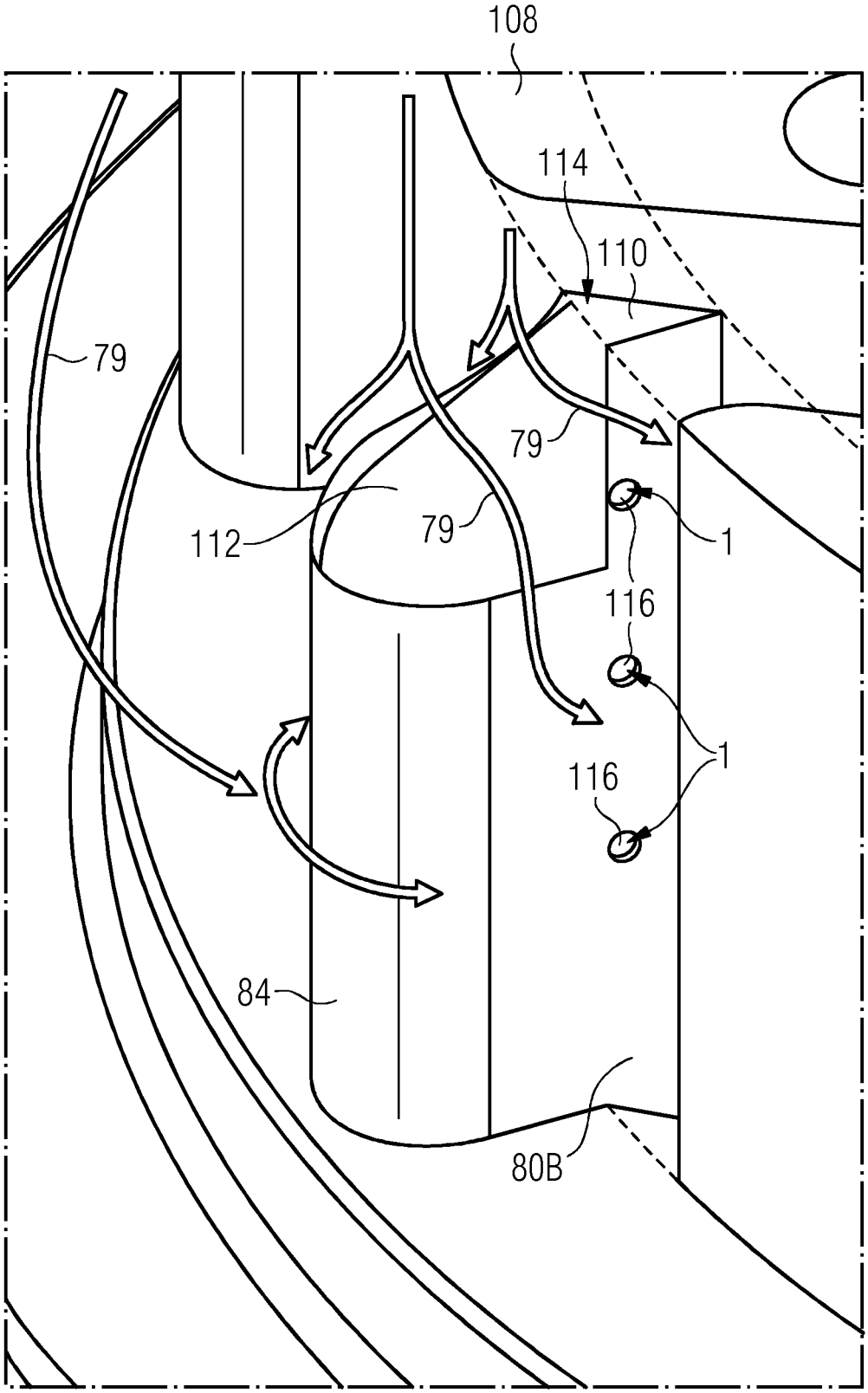
FIG. 9 is a perspective view of one of the obstruction elements looking circumferentially and radially inwardly, in particular the view shows an aerodynamic shoulder that is exposed to the air flow to the swirler.
Figure 10:
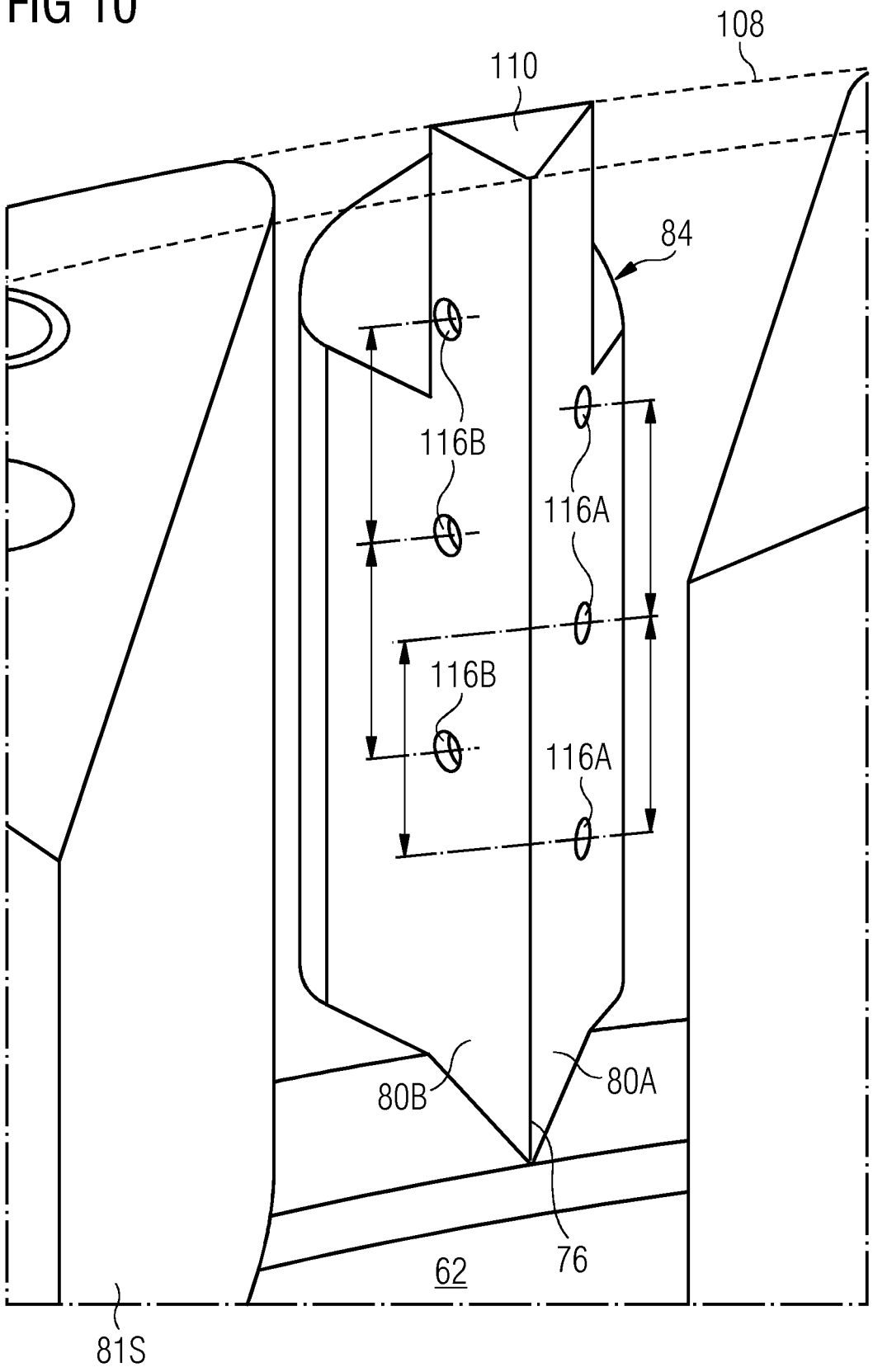
FIG. 10 is a perspective view on a trailing edge of the obstruction element and looking radially outwardly, in particular the view illustrates the position of fuel outlets on the surfaces either side of the trailing edge.

Thus the remainder portion 112 of the end surface 114 of the obstruction elements 66, 84 extends radially outwardly of the top plate 108 as can be seen in FIG. 9. The fluid flow 79 impinges on this surface and advantageously the surface is smoothly contoured to provide an aerodynamic surface for the fluid 79. This aerodynamic profiling helps smooth the airflow 79 and reduce losses while providing a steady air flow for good injection of fuel from the outlets 116, 116A, 116B.

Figure 11:
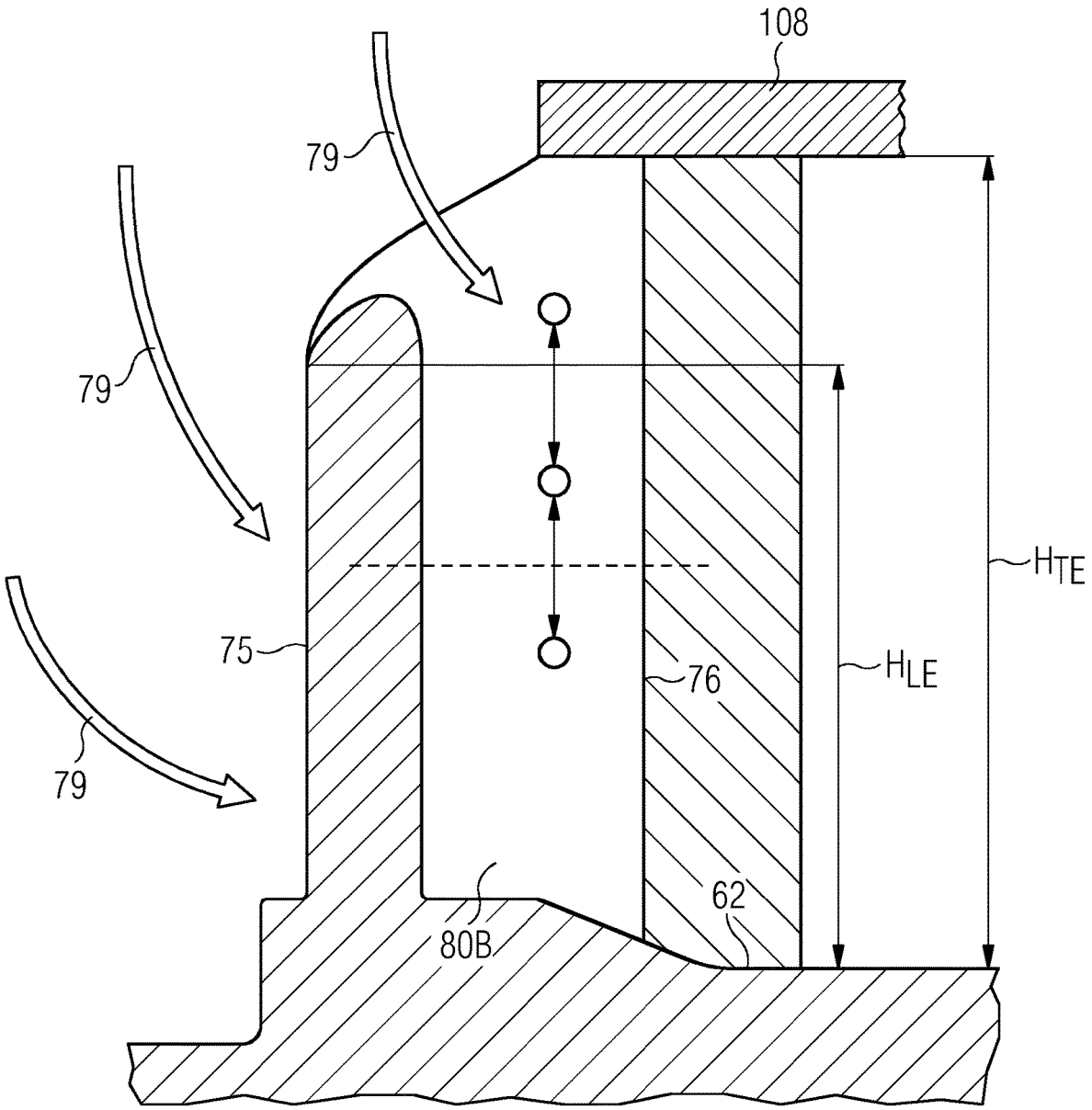
FIG. 11 is a side elevation on an obstruction element and looking generally in a circumferential direction, the view shows the aerodynamic shoulder and a top plate of the swirler.

Shown in FIG. 11, the leading edge 75 has a height $H_{LE}$ and the trailing edge 76 has a height $H_{TE}$. The leading edge $H_{LE}$ is less than trailing edge height $H_{TE}$ and there is a smooth transition over the remainder portion 112 of the surface 114 from portion 110 covered by the top plate 108. This shoulder is angled to meet the air flow 79 as it turns from an axial direction to a generally radial direction as it passes through the swirler slots.

To emphasise the aerofoil shape of the obstruction element 66, 84, in a plane perpendicular to the central axis 63, the shape is a symmetrical teardrop 84 (FIG. 8) or a curved teardrop 66 (FIGS. 2-5). The cross-sectional shapes have a maximum thickness $T_{max}$ nearer the leading edge 75 than the trailing edge 76 and the shape generally tapers from the maximum thickness $T_{max}$ to the leading edge 75.

Turning now to the fuel injection configurations. Each obstruction element 66, 84 has a first surface 80A and a second surface 80B respectively facing a suction surface (1S and a pressure surface 81P of the main swirler elements 65.

wherein there is at least one fuel injector 1 having an outlet 116A, 116B in each of the first surface 80A and the second surface 80B respectively.

In the advantageous embodiment shown in particular in the FIGS. 8-11, there is a plurality of fuel injectors 1 having at least one outlet 116A, 116B in each of the first surface 80A and second surface 80B. The outlets 116A of fuel injectors 1 in the first surface 80A are axially off-set from the outlets 116B of fuel injectors 1 in the second surface 80B. The outlets 116B of fuel injectors 1 on the second surface 80B are located symmetrically about a mid-height of the trailing edge 76. Here the outlets 116A of fuel injectors 1 on the first surface 80A are located approximately mid-pitch of the outlets 116B of fuel injectors 1 on the second surface 80B. For the exemplary embodiment shown, there are three outlets 116A, 116B of fuel injectors 1 on each of the first surface 80A and the second surface 80B. In these configurations, fuel is distributed more evenly across the axial height of the swirler slot 67 or and advantageously within the fluid flow so that it burns in the correct location within the combustion chamber.

The invention claimed is:

1. A swirler for mixing fuel with air in a combustion engine, comprising:

a central axis, a swirler base comprising an upper surface, a central portion, a number of main swirler elements and a number of obstruction elements;

wherein each obstruction element of the number of obstruction elements comprises a leading edge and a trailing edge, the trailing edge is located radially inward of the leading edge;

wherein the number of main swirler elements and the number of obstruction elements are located at the upper surface of the swirler base and are arranged around the central portion;

wherein the number of main swirler elements form a number of swirler slots each comprising a centre-line, each configured for directing a fluid towards the central portion, and each comprising a slot inlet formed at a radius Ri and a slot outlet, wherein the slot outlet is located at a smaller radial distance from the central axis than the slot inlet;

wherein each obstruction element is located to intersect a slot inlet of an associated swirler slot of the number of swirler slots, and wherein each obstruction element together with main swirler elements of the associated swirler slot form two flow channels which feed into and then unite in the associated swirler slot;

wherein the trailing edge of the obstruction element is located in the associated swirler slot between the slot inlet and a location that is a distance up to 0.2Ri radially inward of the slot inlet; and wherein at least one fuel injector outlet is formed in the obstruction element at a distance up to 0.2Ri from the trailing edge.

2. The swirler as claimed in claim 1, wherein each swirler slot of the number of swirler slots is defined between a pressure surface and a suction surface of associated opposing main swirler elements of the number of main swirler elements and comprises a width W, and wherein the trailing edge of each obstruction element of the number of obstruction elements is off-set from an associated centre-line a distance 0.05 W.

3. The swirler as claimed in claim 1, wherein each obstruction element of the number of obstruction elements comprises a chord line that extends from the leading edge to the trailing edge, and wherein the chord line is angled β between 5° and 25° from an associated centre-line.

4. The swirler as claimed in claim 1, further comprising:

a top plate, wherein each main swirler element comprises an end surface that is disposed on an end of the main swirler element that is axially opposite the swirler base, and wherein the top plate further defines the number of swirler slots and abuts at least a portion of each end surface.

5. The swirler as claimed in claim 4, wherein a remainder portion of each end surface extends radially outwardly of a radial outermost edge of the top plate, and wherein the remainder portion of the end surface is smoothly contoured to provide an aerodynamic surface for the fluid.

6. The swirler as claimed in claim 1, wherein each leading edge comprises a height $H_{LE}$ and each trailing edge comprises a height $H_{TE}$, wherein $H_{LE}$ is less than $H_{TE}$.

7. The swirler as claimed in claim 1, wherein at least one obstruction element of the number of obstruction elements comprises a shape in cross section in a plane perpendicular to the central axis that is a symmetrical teardrop or curved teardrop and the shape comprises a maximum thickness $T_{max}$ nearer the leading edge of the at least one obstruction element than the trailing edge of the at least one obstruction element and the shape generally tapers from the maximum thickness $T_{max}$ to the leading edge of the at least one obstruction element.

8. The swirler as claimed in claim 1, wherein each obstruction element comprises a first surface and a second surface respectively facing a suction surface and a pressure surface of associated main swirler elements of the number of main swirler elements, and wherein the at least one fuel injector outlet comprises at least one fuel injector outlet in each of the first surface and the second surface.

9. The swirler as claimed in claim 8, wherein the at least one fuel injector outlet in the first surface comprises plural fuel injector outlets in the first surface, wherein the at least one fuel injector outlet in the second surface comprises plural fuel injector outlets in the second surface, and wherein the plural fuel injector outlets in the first surface are axially off-set from the plural fuel injector outlets in the second surface.

10. The swirler as claimed in claim 9, wherein the fuel injector outlets of the plural fuel injector outlets on the second surface are located symmetrically about a mid-height of an associated trailing edge.

11. The swirler as claimed in claim 10, wherein fuel injector outlets of the plural fuel injector outlets on the first surface are located mid-pitch of the fuel injector outlets of the plural fuel injector outlets on the second surface.

12. The swirler as claimed in claim 9, wherein the plural fuel injector outlets in the first surface comprise three fuel injector outlets in the first surface, and wherein the plural fuel injector outlets in the second surface comprise three fuel injector outlets in the second surface.

13. A burner for a combustion engine comprising:

at least one swirler as claimed in claim 1.

14. A gas turbine comprising:

at least one swirler as claimed in claim 1.

15. A method for mixing fuel with air for use in a combustion engine, comprising:

injecting the air into the swirler as claimed in claim 1, dividing the air into plural airflows, each air flow of the plural airflows flowing in a respective swirler slot of the number of swirler slots, injecting the fuel into the air via the at least one fuel injector outlet.

16. The swirler as claimed in claim 2, wherein the off-set is towards the suction surface.

17. The swirler as claimed in claim 3, wherein the chord line is angled β between 10° and 20° from the associated centre-line.

18. The swirler as claimed in claim 3, wherein the chord line is angled β approximately 15° from the associated centre-line.

* * * * *